US012031773B2

(12) United States Patent
Silva

(10) Patent No.: US 12,031,773 B2
(45) Date of Patent: Jul. 9, 2024

(54) FREEZABLE COOLER PARTITION

(71) Applicant: ARCTIC DISC LIMITED, Manchester (GB)

(72) Inventor: Joseph Silva, Reno, NV (US)

(73) Assignee: ARCTIC DISC LIMITED, Manchester (GB)

( * ) Notice: Subject to any disclaimer, the term of this patent is extended or adjusted under 35 U.S.C. 154(b) by 0 days.

(21) Appl. No.: 17/062,052

(22) Filed: Oct. 2, 2020

(65) Prior Publication Data

US 2021/0131723 A1 May 6, 2021

Related U.S. Application Data

(60) Provisional application No. 62/928,763, filed on Oct. 31, 2019.

(51) Int. Cl.

| | |
|---|---|
| ***F25D 25/02*** | (2006.01) |
| ***F25D 3/08*** | (2006.01) |
| ***F25D 31/00*** | (2006.01) |

(52) U.S. Cl.

CPC ..... *F25D 25/028* (2013.01); *F25D 3/08* (2013.01); *F25D 31/006* (2013.01); *F25D 2303/08222* (2013.01); *F25D 2303/0842* (2013.01); *F25D 2331/802* (2013.01)

(58) Field of Classification Search

CPC ..... F25D 25/028; F25D 3/08; F25D 31/006; F25D 2303/08222; F25D 2303/0842; F25D 2331/802; F25D 5/02; F25D 23/069

See application file for complete search history.

(56) References Cited

U.S. PATENT DOCUMENTS

| | | | | |
|---|---|---|---|---|
| 3,974,658 | A * | 8/1976 | Starrett | B65D 25/02 62/60 |
| 5,129,238 | A * | 7/1992 | Schwartz | A47G 19/2288 220/904 |
| 5,406,808 | A * | 4/1995 | Babb | A47J 41/0005 220/379 |
| 5,507,156 | A | 4/1996 | Redmon | |
| 6,688,135 | B1 * | 2/2004 | Mattia | F25D 3/08 62/457.1 |
| 7,069,739 | B2 * | 7/2006 | Porter | F25D 31/007 126/262 |
| 2006/0185384 | A1 | 8/2006 | Roth et al. | |
| 2008/0000259 | A1 | 1/2008 | Shewchuk | |
| 2010/0270316 | A1 | 10/2010 | Sahlström | |
| 2016/0054045 | A1 * | 2/2016 | Sassman | F25D 3/08 280/63 |

* cited by examiner

*Primary Examiner* — Elizabeth J Martin
*Assistant Examiner* — Samba Nmn Gaye
(74) *Attorney, Agent, or Firm* — Hoffman Warnick LLC

(57) ABSTRACT

The device includes a disk having a central aperture therethrough, wherein the disk defines an interior volume about the central aperture. The disk is dimensioned to partition a cooler into an upper compartment and a lower compartment. A regulator includes an upper portion and a lower portion, wherein the lower portion is removably securable within the central aperture. An opening is disposed within the upper portion and is in fluid communication with a channel extending through the regulator. An elongated rod having an upper end opposite a lower end is removably securable to the upper portion of the regulator. A platform is disposed on the upper end of the elongated rod.

19 Claims, 4 Drawing Sheets

FREEZABLE COOLER PARTITION

CROSS REFERENCE TO RELATED APPLICATIONS

This application claims the benefit of U.S. Provisional Application No. 62/928,763 filed on Oct. 31, 2019. The above identified patent application is herein incorporated by reference in its entirety to provide continuity of disclosure

BACKGROUND OF THE INVENTION

The present invention relates to a freezable cooler insert. More particularly, the present invention pertains to a cooler insert that partitions the cooler into an upper compartment and a lower compartment, such that the lower compartment contains dispensable liquid that is maintained at a desired reduced temperature for an extended period of time.

Many individuals utilize coolers to transport and maintain drinks at a desired reduced temperature for various outings, such as picnics, barbecues, sporting events, beach days, and the like. The insulated nature of these coolers ensures that liquids stored therein are maintained at a desired temperature for a greater length of time than if otherwise exposed. This insulation, however, is not perfectly efficient. Over time, ice within the cooler will melt, leading to the contents of the cooler warming. Additionally, melted ice may further dilute the contents of the cooler, negatively impacting the flavor of the beverage. Once the beverage within the cooler warms to undesired temperatures, individuals may no longer derive maximum refreshment from the beverage. Therefore, a device that can maintain a beverage within a cooler at a reduced temperature for an increased length of time without diluting the beverage is desired.

In light of the devices disclosed in the known art, it is submitted that the present invention substantially diverges in design elements from the known art and consequently it is clear that there is a need in the art for an improvement to existing freezable cooler inserts. In this regard, the instant invention substantially fulfills these needs.

SUMMARY OF THE INVENTION

In view of the foregoing disadvantages inherent in the known types of freezable cooler inserts now present in the known art, the present invention provides a freezable cooler partition wherein the same can be utilized for providing convenience for the user when maintaining a volume of liquid within a cooler at a desired reduced temperature for an extended period of time.

The present system comprises a disk having a central aperture therethrough, wherein the disk defines an interior volume about the central aperture. The disk is dimensioned to partition a cooler into an upper compartment and a lower compartment. The system further comprises a regulator having an upper portion and a lower portion, wherein the lower portion is removably securable within the central aperture. An opening is disposed within the upper portion, wherein the opening is in fluid communication with a channel extending through the regulator. The system further comprises an elongated rod having an upper end opposite a lower end, wherein the lower end is removably securable to the upper portion of the regulator. A platform is disposed on the upper end of the elongated rod, wherein the platform is configured to rest flush against an interior of a cooler lid during use. In some embodiments, the platform is removably securable to the upper end of the elongated rod.

In another embodiment, the disk further comprises an inlet through an upper surface thereof, the inlet providing access to the interior volume. In other embodiments, a cap is removably securable over the inlet. In some embodiments, the cap is securable to a lip extending away from the upper surface of the disk about the perimeter of the inlet. In yet another embodiment, a gasket is disposed about an outer rim of the disk, wherein the gasket frictionally engages an interior of the cooler. In some embodiments, the elongated rod is telescopically adjustable in length. In another embodiment, a material is disposed within the interior volume, wherein the material is configured to react endothermically when combined with water. In some such embodiments, the material is a gel. In other embodiments, the upper end of the elongated rod tapers radially outwardly to match a diameter of the platform. In yet another embodiment, the regulator comprises a pair of openings disposed on opposing sides of the upper portion.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
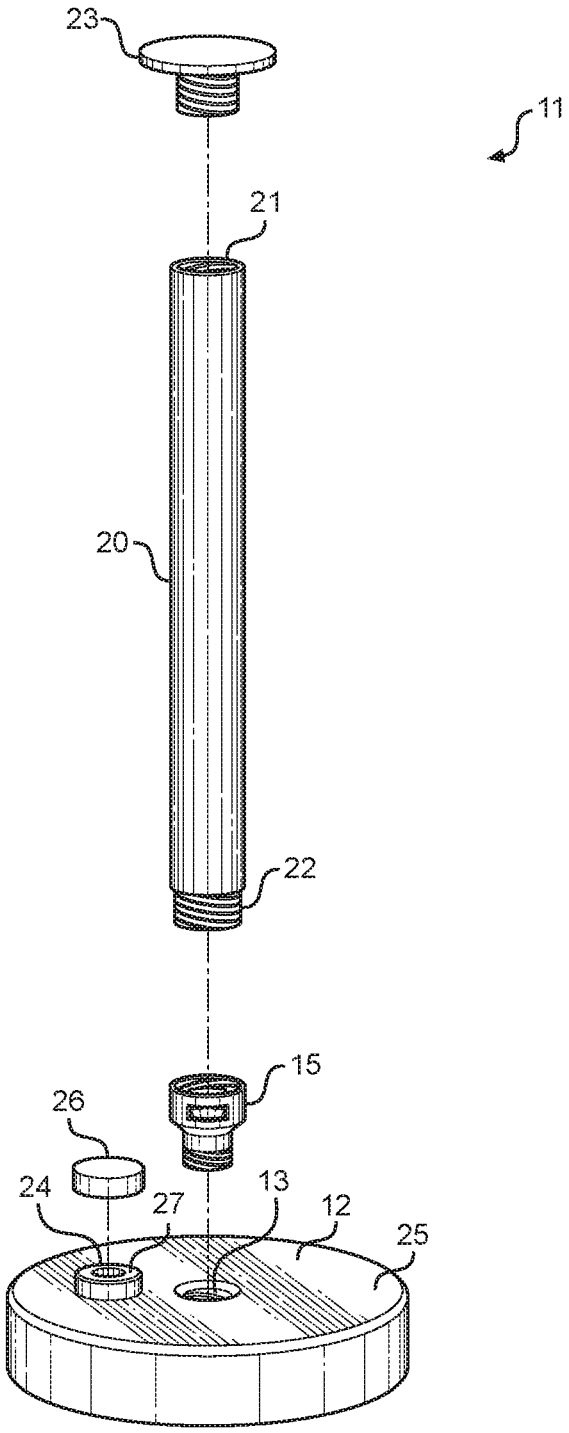
FIG. 1 shows an exploded view of an embodiment of the freezable cooler partition.

Reference is made herein to the attached drawings. Like reference numerals are used throughout the drawings to depict like or similar elements of the freezable cooler partition. The figures are intended for representative purposes only and should not be considered to be limiting in any respect.

Figure 4:
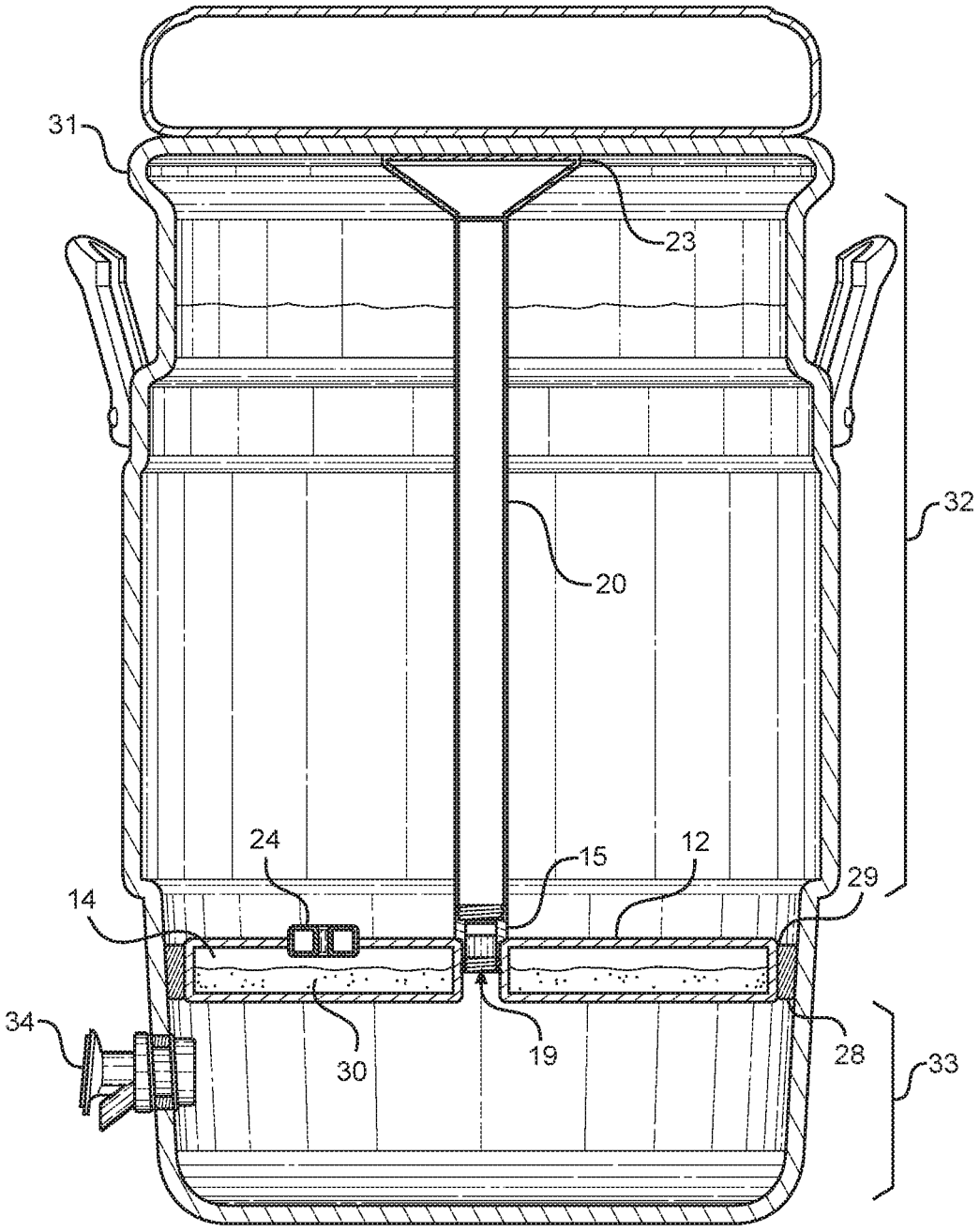
FIG. 4 shows a cross-sectional view of an embodiment of the freezable cooler partition disposed within a cooler.

Referring now to FIG. 1, there is shown an exploded view of an embodiment of the freezable cooler partition. The freezable cooler partition 11 comprises a disk 12 having a central aperture 13 therethrough. In the illustrated embodiment, a regulator 15 is removably securable within the central aperture 13, wherein the regulator 15 is configured to allow fluid to flow from one side of the disk 12 to the other through the central aperture 13 in a controlled manner. The disk 12 defines an interior volume (as shown in FIG. 4, 14) about the central aperture 13. In this manner, the user can fill the disk 12 with a cooling material to maintain an interior of a cooler at a desired temperature. In some embodiments, the disk is contemplated to comprise a freezable fluid permanently secured therein, similar to a traditional ice pack or the like, in which a user can freeze the disk 12 before use. Alternatively, and as presented in further detail elsewhere herein, the disk 12 is contemplated to include an endothermically reactive material therein, such that when water is introduced to the interior volume, the endothermically reactive material cools the disk 12 and the surrounding area. In the illustrated embodiment, the disk 12 further comprises an inlet 24 therein, wherein the inlet 24 provides access to the interior volume, such that the user can refill the disk 12 with a desired cooling material. In the illustrated embodiment, the inlet 24 is offset from a center of the disk 12. In the shown embodiment, a lip 27 extends orthogonally from an upper surface 25 of the disk 12 about a perimeter of the inlet 24, wherein the lip 27 is configured to removably secure cap 26 thereon. The cap 26 is contemplated to be removably secured to the lip 27 via friction fit, complementary threading, or similar securement mechanisms.

The freezable cooler partition 11 further comprising an elongated rod 20 having an upper end 21 opposite a lower end 22. The lower end 22 is removably securable within the regulator 15, such that the elongated rod 20 is secured to the disk 12 thereby. The elongated rod 20 is dimensioned to ensure that the disk 12 is maintained at a desired depth within a cooler. In this manner, the user can ensure that the disk 12 is fully submerged within the fluid disposed within the cooler. In the illustrated embodiment, a platform 23 is removably securable within the upper end 21 of the elongated rod 20, wherein the platform 23 comprises a planar form factor. The platform 23 is dimensioned to rest flush against a lid of the cooler to provide stability to the disk 12 within the cooler. In the shown embodiment, the various connections between the platform 23, the elongated rod 20, and the regulator 15 comprise complementary threaded connections, however alternate securement means, including, but not limited to friction fit are contemplated.

Figure 2:
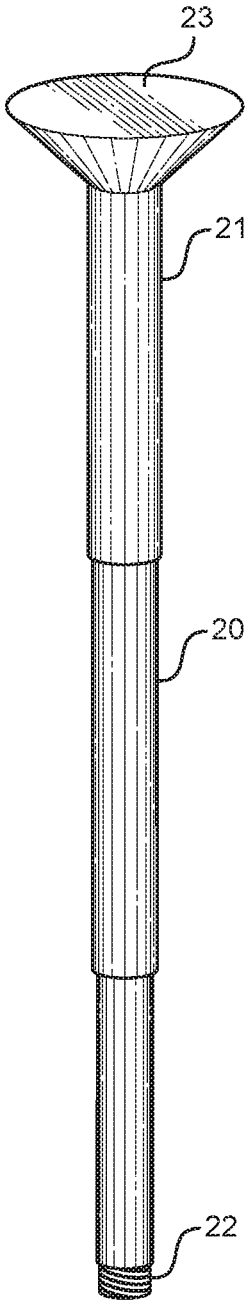
FIG. 2 shows a perspective view of the elongated rod of an embodiment of the freezable cooler partition.

Referring now to FIG. 2, there is shown a perspective view of the elongated rod of an embodiment of the freezable cooler partition. In the illustrated embodiment, the elongated rod 20 comprises a plurality of telescopic sections configured to selectively adjust a length of the elongated rod 20 between the upper end 21 and the lower end 22. In this manner, the user can adjust a depth of the attached disk to ensure that the disk is submerged within the fluid within the cooler as the volume of fluid in the cooler decreases. The telescopic sections can be maintained in an extended position via frictional engagement, however, in alternate embodiments, the telescopic sections each include a ball-detest mechanism configured to retain the elongated rod 20 in an extended position. In the illustrated embodiment, the platform 23 is permanently affixed to the upper end 21 of the elongated rod 20, such that the elongated rod 20 and the platform 23 comprise a unitary structure. Furthermore, in the shown embodiment, the upper end 21 tapers radially outwardly to match a diameter of the platform 23 such that the platform 23 is stabilized against the elongated rod 20.

Figure 3:
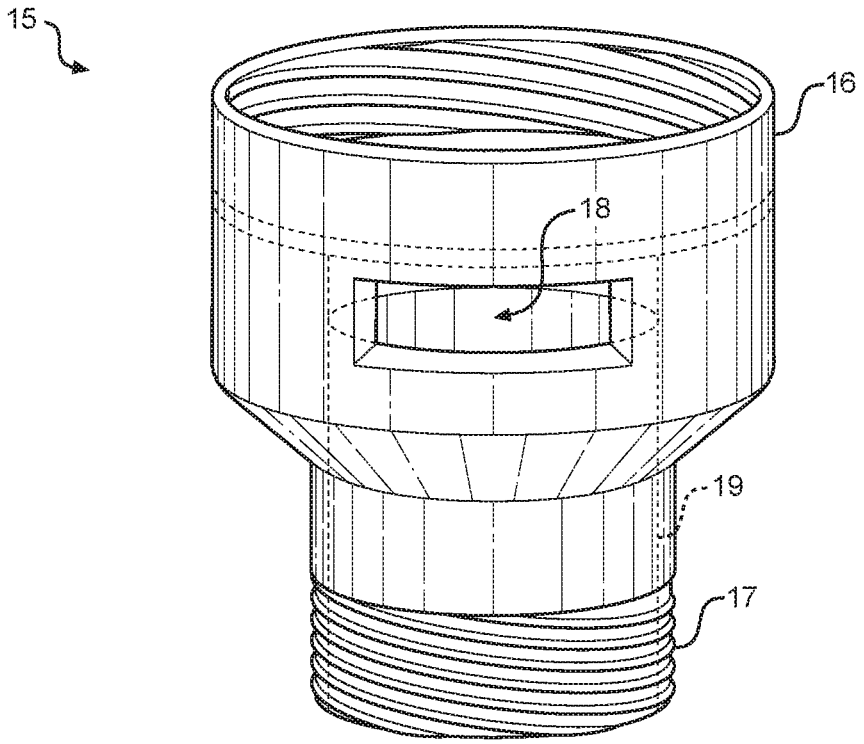
FIG. 3 shows a perspective view of the regulator of an embodiment of the freezable cooler partition.

Referring now to FIG. 3, there is shown a perspective view of the regulator of an embodiment of the freezable cooler partition. The regulator 15 comprises an upper portion 16 and a lower portion 17, wherein the lower portion 17 is dimensioned to removably secure within the central aperture of the disk. The elongated rod is removably securable within the upper portion 16 of the regulator 15. At least one opening 18 is disposed through the upper portion 16, wherein the opening 18 is in fluid communication with a channel 19 extending through the lower portion 17 of the regulator 15. In some embodiments, a pair of openings 18 are disposed on opposing sides of the upper portion 16, such that the fluid dispensed through the channel 19 is collected from around the upper side of the disk. In this manner, the fluid dispensed through the channel 19 is that nearest to the disk, and therefore, the coldest along the temperature gradient formed by the disk. This ensures that the fluid dispensed from the cooler is that maintained at or near the desired reduced temperature.

Referring now to FIG. 4, there is shown a cross-sectional view of an embodiment of the freezable cooler partition disposed within a cooler. As shown, the disk 12 comprises an interior volume 14 configured to receive a cooling material 30 therein. In some embodiments, the cooling material 30 is merely water that is frozen before use. In this illustrated embodiment, the cooling material 30 comprises a material configured to endothermically react with water, such that the user can introduce water to the interior volume 14 to activate the cooling material 30. In this manner, the user can selectively empty and refill the disk 12 to allow for reusability. In one use, the user can fill the empty disk 12 with a dry or gel-based cooling material 30 via the inlet 24 before arriving at the desired site. Once on site, the user can add water and shake the disk 12 to initiate the endothermic reaction before inserting the disk 12 into the cooler 31.

In the illustrated embodiment, the disk 12 further comprises a gasket 28 disposed about an outer rim 29 of the disk 12. The gasket 28 is configured to frictionally engage an interior wall of the cooler 31 to form a watertight seal to partition the cooler 31 into an upper compartment 32 and a lower compartment 33. In the shown embodiment, the upper compartment 32 comprises a larger volume than the lower compartment 33, wherein the lower compartment 33 is disposed adjacent to a spout 34 of the cooler 31. In the shown embodiment, the upper compartment 32 comprises approximately 80% of the total volume of the cooler 31, while the lower compartment 33 comprises approximately 20% of the total volume of the cooler 31. Due to the volume difference between the upper compartment 32 and the lower compartment 33, the upper compartment 32 comprises a temperature gradient wherein the fluid within the upper compartment 32 nearest the disk 12 is cooler than that nearer to the lid of the cooler 31. The partitioning of the cooler 31 ensures that the decreased volume of the lower compartment 33 is maintained at a lower temperature than the upper compartment 32 on average, such that fluid dispensed from the spout 34 is at a desired lower temperature. Once fluid has been dispensed, the fluid adjacent to the disk 12 flows through the regulator 15 and the channel 19 into the lower compartment 33. In this manner, the temperature change within the lower compartment 33 is minimized to maintain the temperature of the fluid at or near a desired temperature for an increased length of time.

In one use, the disk 12 is filled with a cooling material 30. This cooling material 30 can either be frozen in a conventional freezer, or can comprise an endothermically reactive material, such that when combined with water, the disk 12 cools the surrounding area. In such embodiments, the user can fill the disk 12 with the cooling material 30 and add water to initiate the reaction. The regulator 15 is then secured within the central aperture of the disk 12. The disk 12 is then inserted within the cooler 31 and secured at a desired depth by securing the elongated rod 20 into the regulator 15 and placing the platform 23 against an interior surface of the cooler 31 lid. Once the disk 12 is secured within the cooler 31 to partition the cooler 31 into an upper compartment 32 and a lower compartment 33, the decreased volume of the lower compartment 33 is rapidly cooled by the disk 12, while the upper compartment 32 is slowly brought down to the desired temperature. As fluid is dispensed from the cooler 31, the fluid adjacent to the disk 12 flows through the channel 19 of the regulator 15 into the lower compartment 33. This fluid nearest the disk 12 comprises the lowest temperature of the fluid within the upper compartment 32, ensuring that the lower compartment 33 is maintained at or near the desired decreased temperature.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A freezable cooler partition, comprising:

a disk having a central aperture therethrough, wherein the disk defines an interior volume about the central aperture;

wherein the disk is dimensioned to partition a cooler for cooling a fluid into an upper compartment and a lower compartment from which the fluid is dispensable;

a regulator for controlling a fluid flow between the upper compartment and the lower compartment having an upper portion and a lower portion, wherein the lower portion is removably securable within the central aperture;

an opening within the upper portion, the opening in fluid communication with a channel extending through the regulator allowing the fluid to flow from the upper compartment to the lower compartment;

an elongated rod having an upper end opposite a lower end, wherein the lower end is removably securable to the upper portion of the regulator;

a platform disposed on the upper end of the elongated rod.

2. The freezable cooler partition of claim 1, further comprising an inlet on an upper surface of the disk, wherein the inlet provides access to the interior volume.

3. The freezable cooler partition of claim 2, further comprising a cap removably securable over the inlet.

4. The freezable cooler partition of claim 3, further comprising a lip extending away from the upper surface about a perimeter of the inlet, wherein the cap removably secures about the lip.

5. The freezable cooler partition of claim 1, further comprising a gasket disposed about an outer rim of the disk, wherein the gasket frictionally engages an interior of the cooler.

6. The freezable cooler partition of claim 1, wherein the elongated rod is telescopically adjustable in length.

7. The freezable cooler partition of claim 1, further comprising a material within the interior volume configured to react endothermically when combined with water.

8. The freezable cooler partition of claim 7, wherein the material comprises a gel.

9. The freezable cooler partition of claim 1, wherein the upper end of the elongated rod tapers radially outwardly to match a diameter of the platform.

10. The freezable cooler partition of claim 1, wherein the regulator comprises a pair of openings disposed on opposing sides of the upper portion.

11. A freezable cooler partition, comprising:

a disk having a central aperture therethrough, wherein the disk defines an interior volume about the central aperture;

wherein the disk is dimensioned to partition a cooler into an upper compartment and a lower compartment;

a regulator having an upper portion and a lower portion, wherein the lower portion is removably securable within the central aperture;

an opening within the upper portion, the opening in fluid communication with a channel extending through the regulator allowing the fluid to flow from the upper compartment to the lower compartment;

an elongated rod having an upper end opposite a lower end, wherein the lower end is removably securable to the upper portion of the regulator;

a platform removably securable to the upper end of the elongated rod.

12. The freezable cooler partition of claim 11, further comprising an inlet on an upper surface of the disk, wherein the inlet provides access to the interior volume.

13. The freezable cooler partition of claim 12, further comprising a cap removably securable over the inlet.

14. The freezable cooler partition of claim 13, further comprising a lip extending away from the upper surface about a perimeter of the inlet, wherein the cap removably secures about the lip.

15. The freezable cooler partition of claim 11, further comprising a gasket disposed about an outer rim of the disk, wherein the gasket frictionally engages an interior of the cooler.

16. The freezable cooler partition of claim 11, wherein the elongated rod is telescopically adjustable in length.

17. The freezable cooler partition of claim 11, further comprising a material within the interior volume configured to react endothermically when combined with water.

18. The freezable cooler partition of claim 17, wherein the material comprises a gel.

19. The freezable cooler partition of claim 11, wherein the regulator comprises a pair of openings disposed on opposing sides of the upper portion.

* * * * *